US007036256B2

(12) United States Patent
Carlin et al.

(10) Patent No.: US 7,036,256 B2
(45) Date of Patent: May 2, 2006

(54) DISPLAY DEVICE

(75) Inventors: Glenn Carlin, Kent, CT (US); Gilbert Aviles, Accord, NY (US)

(73) Assignee: Crew Design Incorporated, Kent, CT (US)

( * ) Notice: Subject to any disclaimer, the term of this patent is extended or adjusted under 35 U.S.C. 154(b) by 0 days.

(21) Appl. No.: 10/606,306

(22) Filed: Jun. 25, 2003

(65) Prior Publication Data

US 2004/0261302 A1 Dec. 30, 2004

(51) Int. Cl.
*G09F 15/00* (2006.01)
*G09F 11/00* (2006.01)

(52) U.S. Cl. ..... 40/610; 40/529; 40/539

(58) Field of Classification Search ..... 40/610, 40/617, 601, 603, 539, 529; 160/84.04, 370
See application file for complete search history.

(56) References Cited

U.S. PATENT DOCUMENTS 858,313 A * 6/1907 Wells ..... 40/530
2,458,729 A * 1/1949 Politzer ..... 40/530
3,734,809 A * 5/1973 Ellis ..... 428/12
4,270,291 A * 6/1981 Babberl ..... 40/594
4,598,934 A * 7/1986 Cashel ..... 281/5
4,642,605 A * 2/1987 Karp ..... 340/931
4,951,993 A * 8/1990 Taboada ..... 296/136.13
5,413,396 A * 5/1995 Poznansky et al. .... 296/136.13

* cited by examiner

*Primary Examiner*—Cassandra Davis
(74) *Attorney, Agent, or Firm*—McCormick, Paulding & Huber LLP

(57) ABSTRACT

A display device comprises at least first, second and third plates each having forward and rearward surfaces wherein the second plate is rearward of the first plate, and the third plate is rearward of the second plate. A biasing member permits relative movement of adjacent plates between retracted and expanded positions upon pulling the first plate forwardly. The retracted plates are in registration with one another whereby generally only the forward surface of the first plate is exposed for viewing information to be displayed thereon from a position generally forward of the display device. The plates in the expanded position are biased toward the retracted position and oriented such that the forward surface of the first plate, the rearward surface of the second plate and the forward surface of the third plate are exposed for viewing information to be displayed thereon from a position generally forward of the display device.

23 Claims, 6 Drawing Sheets

DISPLAY DEVICE

FIELD OF THE INVENTION

This invention relates generally to a device for displaying information, and more particularly to a display device, with a pull-down information panel, to be attached to a shelf or other mounting surface for displaying advertisements or other information.

BACKGROUND OF THE INVENTION

Display devices attached to shelves for advertising products are well known. Some display devices permit a potential consumer to interact with the device. Such interaction is desirable because some studies suggest that the interaction increases the likelihood of sales by 29% to 50%.

One such interaction display device comprises a flexible advertisement sheet that is initially wound on a roller. The potential consumer may unwind the advertisement sheet from the roller to reveal the advertisement. The roller is biased such that when the advertisement sheet is automatically wound on the roller when the consumer releases the sheet. A drawback with this pull-down display is that the flexible sheet easily wears with each pull, and therefore has a limited operational life. Another drawback is that the several parts of the display device, including the roller, adds to the cost of the product.

It is an object of the present invention to provide an improved information display device that is durable and cost effective.

SUMMARY OF THE INVENTION

A display device comprises a first plate having a forward surface and a rearward surface, and a second plate disposed rearwardly of and adjacent to the first plate. The second plate has a forward surface and a rearward surface. A third plate is disposed rearwardly of and adjacent to the second plate. The third plate has a forward surface and a rearward surface. Biasing means is provided for permitting relative movement of adjacent plates between a retracted position and an expanded position when the first plate is pulled generally in a forward direction and for biasing the plates toward the retracted position for returning the plates to the retracted position when the first plate is released. The plates in the retracted position are generally in registration with one another such that the rearward surface of the first plate faces the forward surface of the second plate, and the rearward surface of the second plate faces the forward surface of the third plate whereby generally only the forward surface of the first plate is exposed for viewing information to be displayed thereon from a position generally forward of the display device. The plates in the expanded position are oriented such that the forward surface of the first plate, the rearward surface of the second plate and the forward surface of the third plate are exposed for viewing information to be displayed thereon from a position generally forward of the display device.

Preferably the display device further comprises a fourth plate and a fifth plate. The fourth plate having a forward and a rearward surface is disposed rearwardly of and adjacent to the third plate. The fifth plate having a forward and a rearward surface is disposed rearwardly of and adjacent to the fourth plate. The plates in the retracted position are generally in registration with one another such that the rearward surface of the third plate faces the forward surface of the fourth plate, and the rearward surface of the fourth plate faces the forward surface of the fifth plate whereby generally only the forward surface of the first plate is exposed for viewing information to be displayed thereon from a position generally forward of the display device. The plates in the expanded position are biased toward the retracted position and oriented such that the forward surface of the first plate, the rearward surface of the second plate, the forward surface of the third plate, the rearward surface of the fourth plate, and the forward surface of the fifth plate are exposed for viewing information to be displayed thereon from a position generally forward of the display device.

DETAILED DESCRIPTION OF THE PREFERRED EMBODIMENTS

Figure 2:
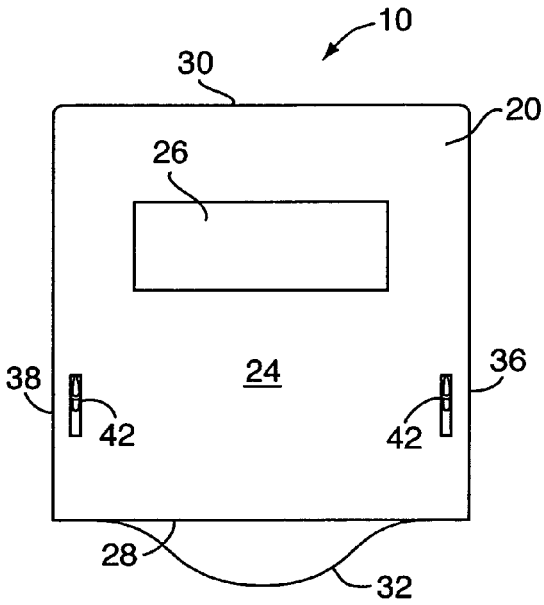
FIG. 2 is a back elevational view of the display device of FIG. 1 in a retracted position.
Figure 3:
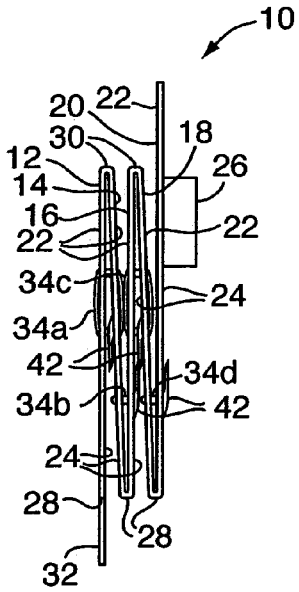
FIG. 3 is a side elevational view of the display device of FIG. 1 in a retracted position.
Figure 4:
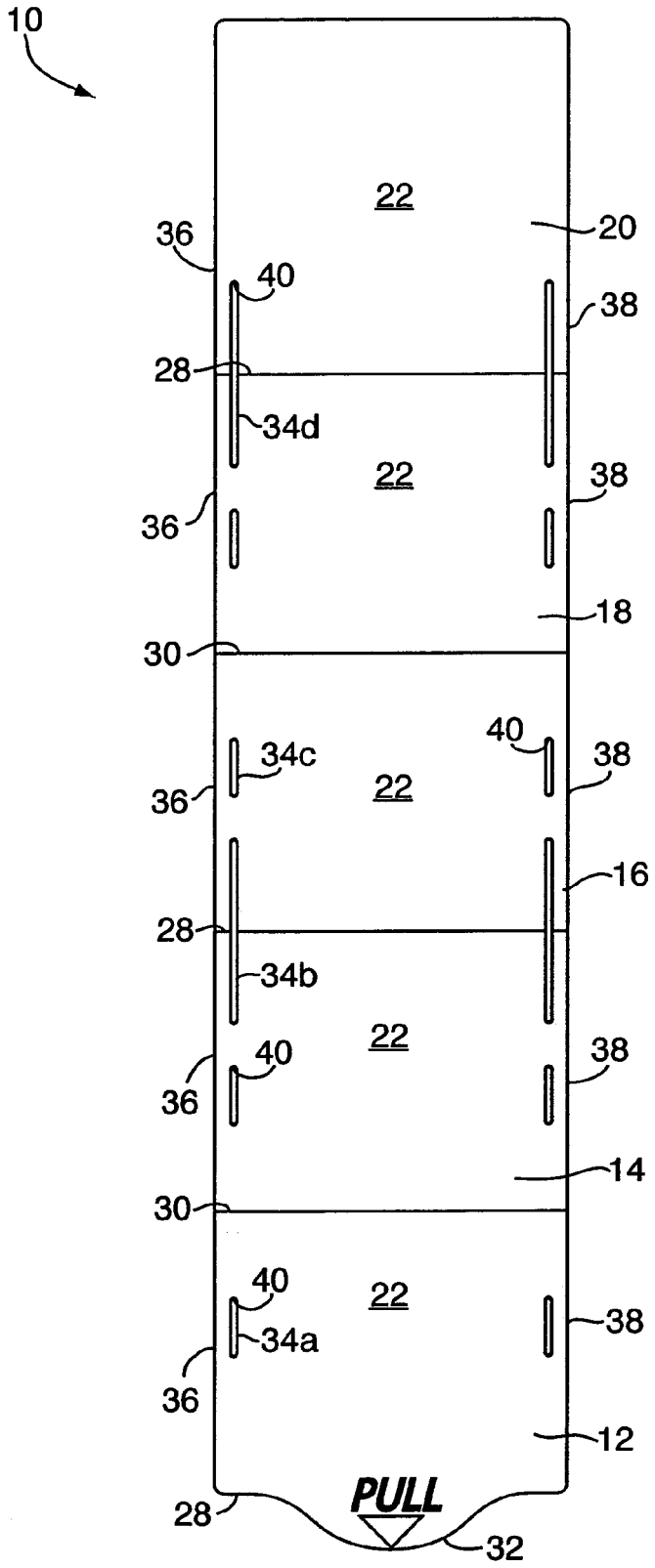
FIG. 4 is a front perspective view of the display device of FIG. 1 in an expanded position.

With reference to FIGS. 1–6, a display device in accordance with a first embodiment of the present invention is generally designated by the reference number 10. As will be explained, the display device 10 is capable of being moved from a retracted position to an expanded position in order to reveal additional promotional information or other material displayed thereon. As best shown in FIG. 4, the display device includes a first plate 12, a second plate 14, a third plate 16, a fourth plate 18 and a fifth plate 20 for displaying promotional or other information in the form of text and/or graphics. The second plate 14 is disposed generally rearwardly of and adjacent to the first plate 12; the third plate 16 is disposed generally rearwardly of and adjacent to the second plate 14; the fourth plate 18 is disposed generally rearwardly of and adjacent to the third plate 16, and the fifth plate 20 is disposed generally rearwardly of and adjacent to the fourth plate 18.

Although five plates are shown by way of example, it should be understood that fewer or additional plates may be employed without departing from the scope of the present invention. The number of plates is preferably an odd number, and may be as few as three. For example, the number of plates may be three, five, seven, nine, etc. Most preferably, the number of plates is five as illustrated in the figures.

Figure 5:
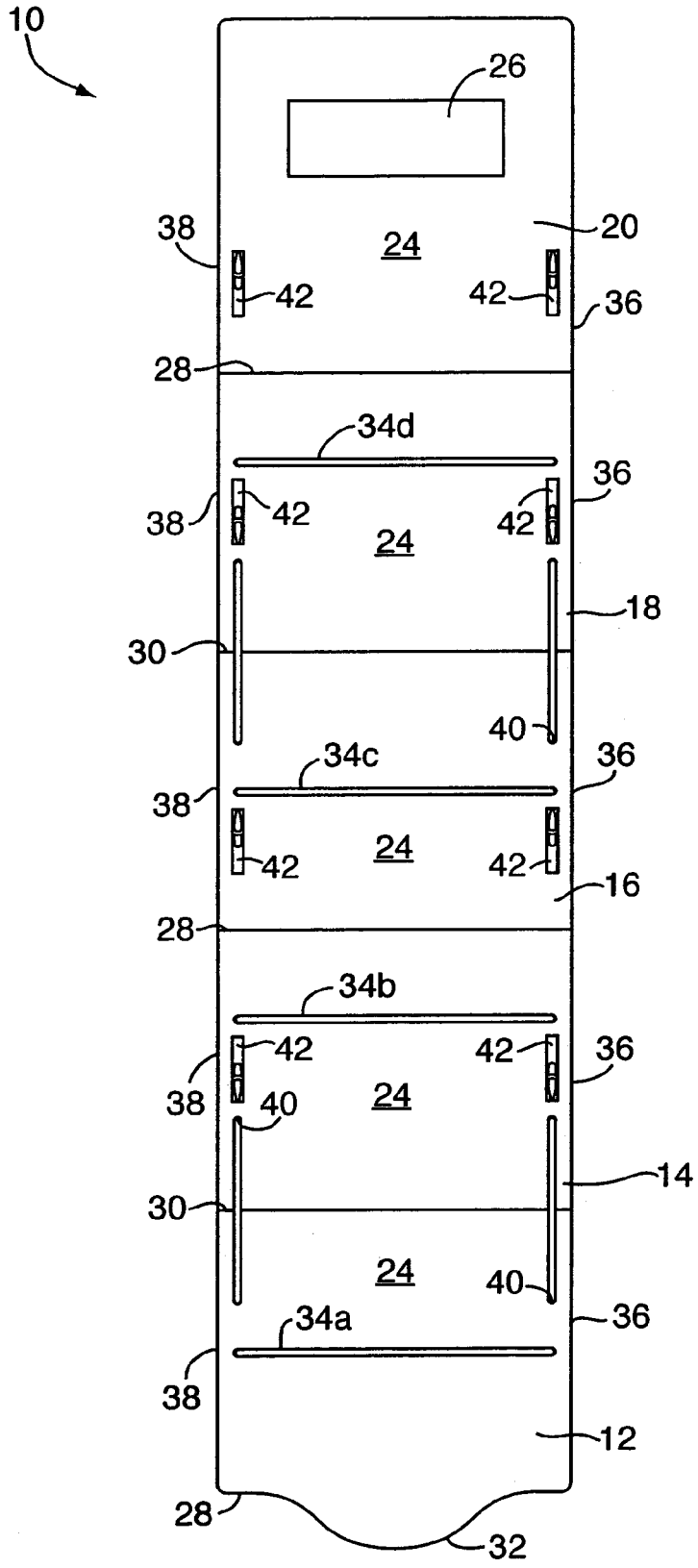
FIG. 5 is a back perspective view of the display device of FIG. 1 in an expanded position.

As shown in FIG. 4, the plates 12, 14, 16, 18 and 20 each have a forward surface 22 that can be printed or otherwise covered with promotional or other information in the form of text and/or graphics. As shown in FIG. 5, the plates 12, 14, 16, 18 and 20 each have a rearward surface 24 which is typically hidden from view and is therefore generally not printed or otherwise covered with promotional or other display material. The display device 10 preferably includes means for attaching the rearmost or fifth plate 20 to a support surface (not shown). As shown in FIGS. 2, 3 and 5, for example, the attaching means may be an adhesive strip 26 mounted on the rearward surface 24 of the fifth plate 20, but is not limited in this regard as other means for attaching such as, for example, hook and loop fasteners, clamps or brackets may be substituted without departing from the scope of the present invention.

As shown in FIG. 3, the first through fifth plates 12, 14, 16, 18 and 20 each have a first edge 28, and a second edge 30 generally at an opposite end relative to the first edge. The first edge 28 of the first plate 12 preferably defines a projection 32 serving as a handle for pulling the plates 12, 14, 16, 18 and 20 from a retracted position (shown in FIGS. 1–3) to an expanded position (shown in FIGS. 4–6) as explained more fully below. Also, the second edge 30 of the rearmost or fifth plate 20 preferably projects beyond the second edges of the first through fourth plates 12, 14, 16 and 18, whereby a portion of the forward surface 22 of the fifth plate 20 projecting beyond the second edges of the other plates is exposed for viewing information to be displayed thereon even while the plates are in the retracted position.

Each of the plates 12 through 20 is preferably hingedly coupled to an adjacent plate. For example, the second edge 30 of the first plate 12 is hingedly coupled to the second edge 30 of the second plate 14. The first edge 28 of the second plate 14 is hingedly coupled to the first edge 28 of the third plate 16. The second edge 30 of the third plate 16 is hingedly coupled to the second edge 30 of the fourth plate 18, and the first edge 28 of the fourth plate 18 is hingedly coupled to the first edge 28 of the fifth plate 20.

As shown in FIG. 3, a continuous sheet of material defining the plates 12, 14, 16, 18 and 20 may be scored or otherwise partly cut through its width at periodic intervals therealong to couple and provide the hinging action between adjacent plates. However, the plates need not be hinged together. Moreover, other ways for providing hinging action may be substituted without departing from the scope of the present invention. For example, hinge devices distinct from the plate material may be employed to connect otherwise separate plates together.

Figure 6:
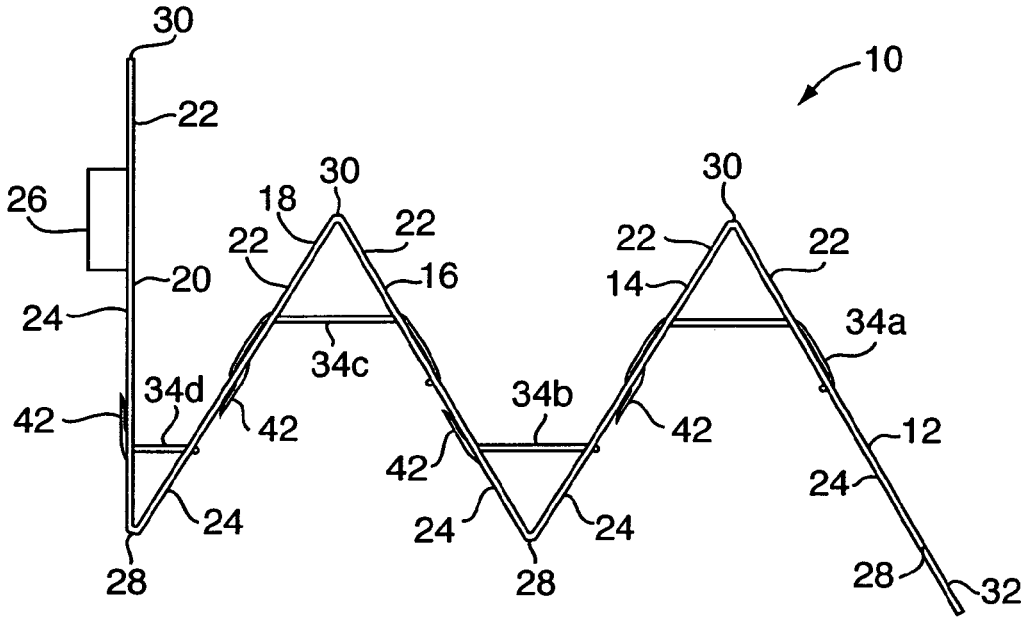
FIG. 6 is a side elevational view of the display device of FIG. 1 in an expanded position.

As best shown in FIGS. 4–6, the plates 12 through 20 are coupled to each other by a biasing means, such as one or more elastic members 34, for permitting relative movement of adjacent plates between a retracted position (shown in FIGS. 4–6) and an expanded position (shown in FIGS. 1–3) when the handle 32 of the first plate 12 is pulled generally in a forward direction, and for biasing the plates toward the retracted position for returning the plates to the retracted position when the first plate is released. The elastic members 34 are shown in the form of cords, but are not limited in this regard. For example, the elastic members may be in the form of springs.

Figure 1:
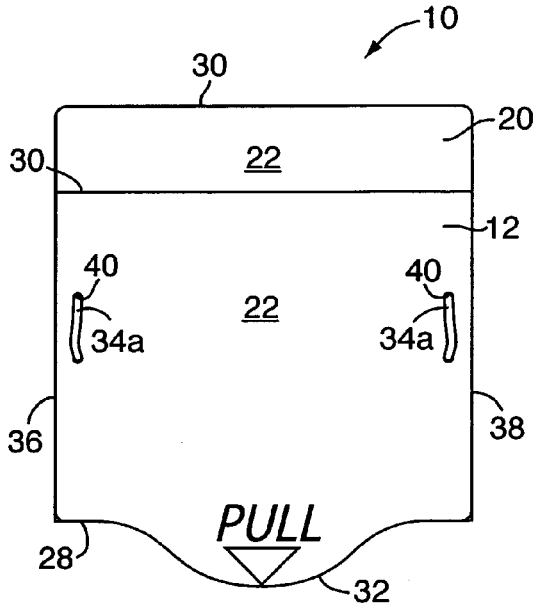
FIG. 1 is a front perspective view of a display device in a retracted position in accordance with a first embodiment of the present invention.

As shown in FIGS. 1–3, the plates 12, 14, 16, 18 and 20 in the retracted position are generally in registration with one another such that the rearward surface 24 of the first plate 12 faces the forward surface 22 of the second plate 14, the rearward surface 24 of the second plate 14 faces the forward surface 22 of the third plate 16, the rearward surface 24 of the third plate 16 faces the forward surface 22 of the fourth plate 18, and the rearward surface 24 of the fourth plate 18 faces the forward surface 22 of the fifth plate 20, whereby generally only the forward surface 22 of the first plate 12 is exposed for viewing information to be displayed thereon from a position generally forward of the display device 10. The plates 12, 14, 16, 18 and 20 in the expanded position are biased by the elastic members 34 toward the retracted position and oriented such that the forward surface 22 of the first plate 12, the rearward surface 24 of the second plate 14, the forward surface 22 of the third plate 16, the rearward surface 24 of the fourth plate 18, and the forward surface 22 of the fifth plate 20 are exposed for viewing information to be displayed thereon from a position generally forward of the display device 10.

As shown in FIG. 4, the plates 12, 14, 16, 18 and 20 each have a third edge 36 and a fourth edge 38 generally at an opposite end relative to the third edge. The third and fourth edges 36, 38 generally extend between associated first and second edges 28, 30. Referring now to FIGS. 1–6, a first elastic member 34*a* is received through holes 40 defined by the first plate 12 and the second plate 14 at locations adjacent to the third and fourth edges 36, 38 thereof to couple the first and second plates together. A second elastic member 34*b* is received through holes 40 defined by the second plate 14 and the third plate 16 at locations adjacent to the third and fourth edges 36, 38 thereof to couple the second and third plates together. A third elastic member 34*c* is received through holes defined by the third plate 16 and the fourth plate 18 at locations adjacent to the third and fourth edges 36, 38 thereof to couple the third and fourth plates together. Similarly, a fourth elastic member 34*d* is received through holes defined by the fourth plate 18 and the fifth plate 20 at locations adjacent to the third and fourth edges 36, 38 thereof to couple the fourth and fifth plates together. Each of the elastic members 34*a*, 34*b*, 34*c* and 34*d* has ends which are secured to one of the two plates the elastic member holds together by a crimping device 42 or other suitable means for securing, such as a staple or knotting the ends of the elastic member.

Figure 8:
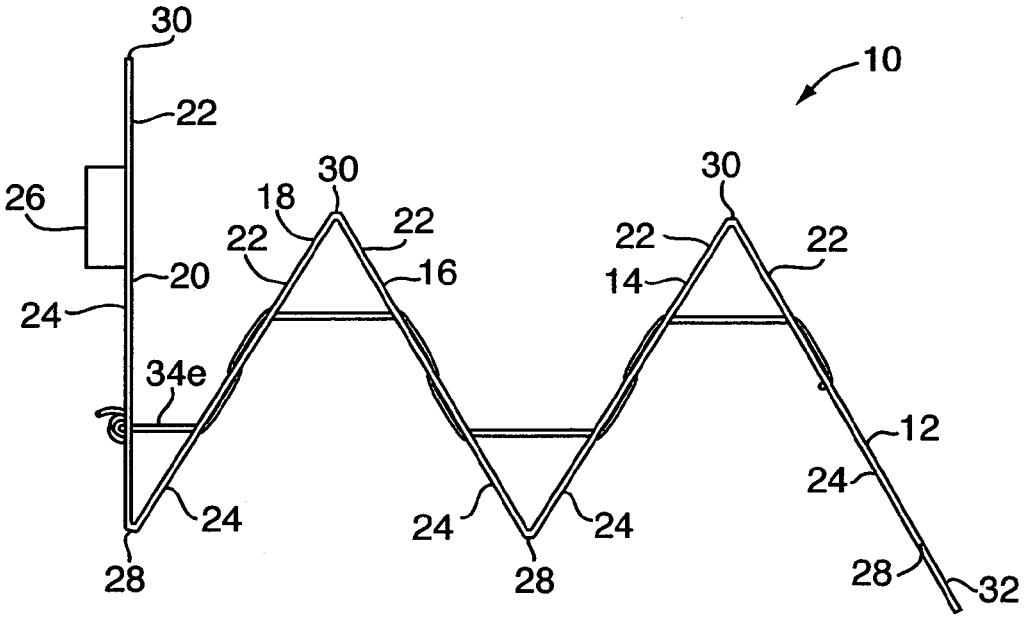
FIG. 8 is a side elevational view of the display device of FIG. 7 in an expanded position.
Figure 7:
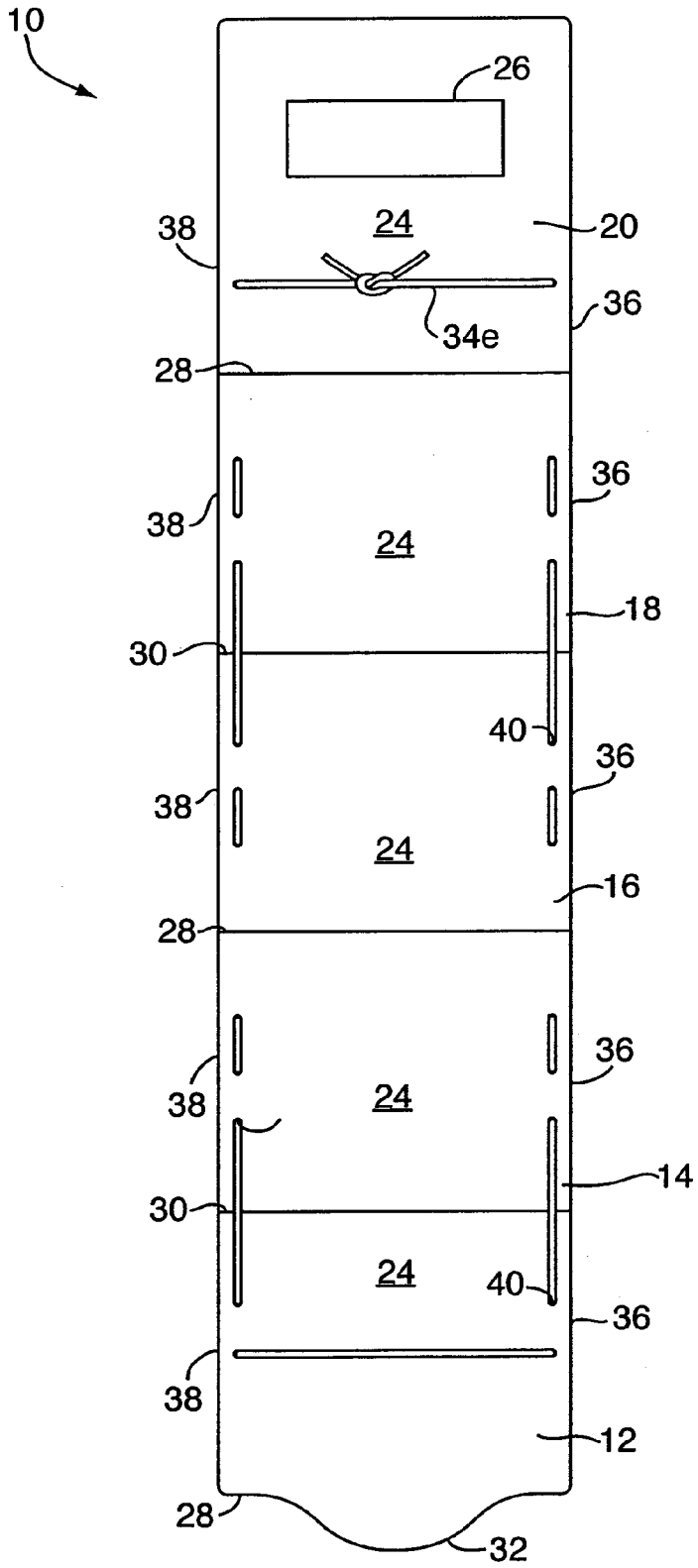
FIG. 7 is a back perspective view of a display device in an expanded position in accordance with a second embodiment of the present invention.

FIGS. 7 and 8 illustrate the display device 10 employing a single elastic member 34*e* received through holes 40 defined by the plates 12 through 20 at locations adjacent to the third and fourth edges 36, 38 thereof. Ends of the single elastic member 34*e* are tied to each other adjacent to the rearward surface 24 of the rearmost or fifth plate 20 so as to be hidden from view. Although the ends of the elastic member 34*e* are shown as tied together, the invention is not limited in this regard as other means for coupling the ends together such as staples or crimping means may be substituted without departing from the scope of the present invention.

Figure 9:
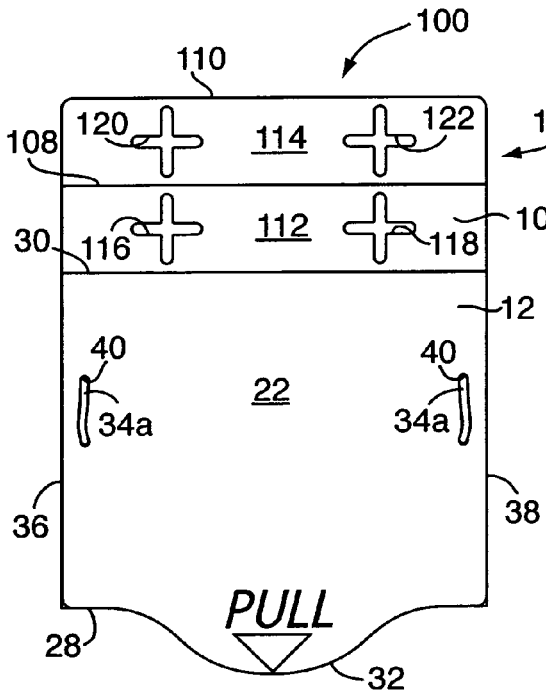
FIG. 9 is a front view of a display device in accordance with a third embodiment of the present invention.
Figure 10:
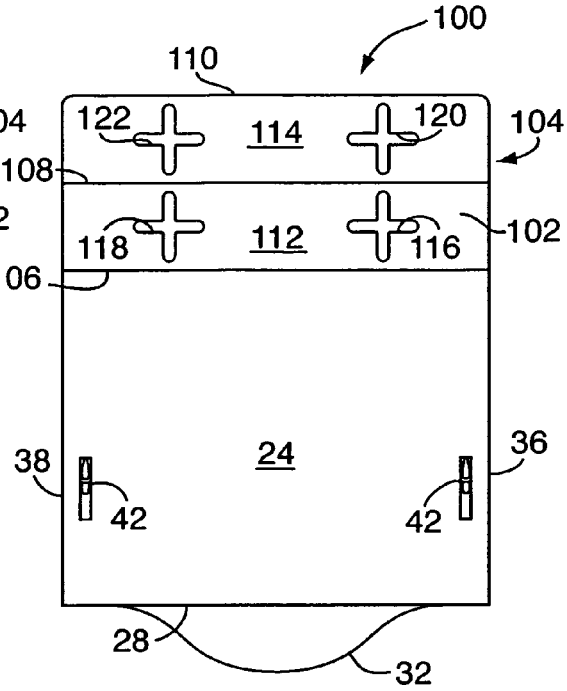
FIG. 10 is a back view of the display device of FIG. 9.
Figure 11:
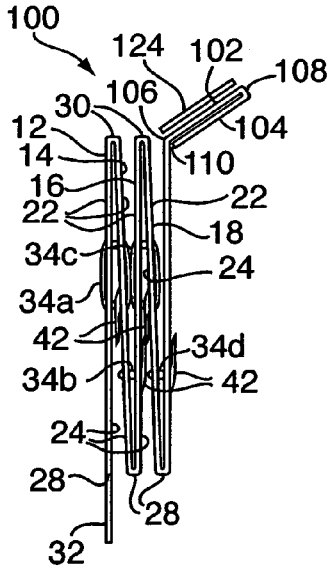
FIG. 11 is a side elevational view of the display device of FIG. 9 in a mounting configuration.

Turning now to FIGS. 9–11, a display device in accordance with another embodiment of the present invention is generally designated by the reference number 100. Like elements of previously explained embodiments are designated by like reference numbers. The display device 100 is similar to the display device 10 except with respect to the structure for mounting the display 100 to an external surface. Accordingly, the display device 100 will be explained only with respect to the mounting structure.

The display device 100 includes a rearmost or fifth plate 102 relative to the first plate 12 that has a mounting portion designated generally by the reference number 104 projecting beyond the second edges of the first through fourth plates 12, 14, 16 and 18. The mounting portion 104 is preferably creased, scored or otherwise weakened along at least one fold line. As shown in FIG. 10, for example, a first fold line 106 is generally disposed in underlying registration to the second edges of the first through fourth plates 12, 14, 16 and 18 when the display device 100 is in a retracted position. A second fold line 108 is generally parallel to the first fold line 106 and disposed along the mounting portion 104 preferably about midway between the first fold line and a second edge 110 of the rearmost plate 102. An area of the mounting portion 104 between the first and second fold lines 106, 108 defines a first mounting section 112, and an area of the mounting portion between the second fold line and the second edge 110 of the rearmost plate 102 defines a second mounting section 114.

The mounting portion 104 preferably defines at least one hole or slot for mounting the display device 100 with fasteners to an external surface such as, for example, the front edge of a standard gondola shelf. As shown in FIGS. 9 and 10, the mounting portion 104 defines four slots 116, 118, 120, 122 each preferably shaped in the form of a cross for reasons explained below. The slots 116, 118 are defined by the mounting portion 104 in the first mounting section 112, and the slots 120, 122 are defined by the mounting portion in the second mounting section 114. The display device 100 is mounted on an external support surface (not shown) by bending the second fold line 108 such that the second mounting section 114 is disposed rearwardly of the first mounting section 112. More specifically, the second fold line 108 is bended such that the slots 120, 122 of the second mounting section 114 are respectively in underlying registration with the slots 116, 118 of the first mounting section 112. Folding the second mounting section 114 rearwardly of the first mounting section 112 doubles the thickness of the rearmost plate 102 in order to increase the structural integrity of the rearmost plate where the plate contacts and is secured to an external surface. The first fold line 106 may be bended so that the plates of the display device 100 may be adjusted to a desired viewing direction. A fastener (not shown) is inserted through the slots 116, 120 of the first and second mounting sections 112, 114 that are in registration with one another, and another fastener is inserted through the slots 118, 122 of the first and second mounting sections that are in registration with one another to secure the display device 100 to an external mounting surface. An overlay or washer plate 124 (see FIG. 11) of a durable material such as, for example, plastic may be placed between the mounting sections 112, 114 and the part of the fasteners received in the slots in order to provide further strength to the mounting section. Preferably, the washer plate 124 has a shape and slots substantially the same as each mounting section 112, 114 to facilitate placing the washer plate on the mounting sections with the slots of the washer plate in overlying registration with the slots of the mounting sections.

An example of each fastener for securing the display 100 to an external mounting surface, such as a gondola shelf, includes a screw with a washer placed over the washer plate 124 and the mounting sections 112, 114, and into and through holes defined in the shelf, and further includes another washer, lock washer and wing nut coupled to the screw underneath the shelf. The slots 116, 118, 120, 122 are illustrated generally in the form of a cross to allow the fasteners to be disposed at various positions within the slots in dependence on the location of receiving holes defined in the external mounting surface or shelf.

In operation, the display device 10, 100 is mounted on a support surface such as a store shelf as explained above. The elastic member(s) 34 is in tension to keep the plates 12, 14, 16, 18 and 20 together in registration with one another in the retracted position (shown in FIGS. 1–3) until a user interacts with the display device 10 by pulling the handle 32. In the retracted position and as shown in FIG. 1, generally only information on the forward surface 22 of the first plate 12 is exposed for viewing. However, a portion of the forward surface 22 of the rearmost or fifth plate 20 projecting beyond the other plates may also be exposed for viewing in the retracted position.

A user may interact with the display device 10 by pulling forwardly or downwardly on the handle 32 to slightly separate adjacent plates from one another as shown in FIGS. 4–6. The elastic member(s) 34 stretch when the handle 32 is pulled to facilitate movement of the plates away from each other so that information on the forward surfaces 22 of all of the plates 12, 14, 16, 18 and 20 may be exposed for viewing by the user. The elastic member(s) 34 are received through the holes 40 at a side location adjacent to the third and fourth edges 36, 38 to minimize interference by the elastic members with the view of information shown on the forward surfaces 22 of the plates. The elastic member(s) 34 also preferably extend between and are received through holes of adjacent plates at a location adjacent to the hinged edges of the plates. This location of the elastic member(s) 34 permits the hinged edges of adjacent plates to more easily pivot away from each other in order to expose the forward surfaces of the second through fifth plates 14, 16, 18 and 20 for viewing when in the expanded position.

When the user is finished viewing all of the information, the user gradually releases his or her exertion on the handle 32 such that the tension within the stretched elastic member (s) 34 pulls the plates 12, 14, 16, 18 and 20 together to the retracted position so that generally only the forward surface 22 of the first plate 12 is exposed for viewing. The display 10 is now ready for interaction with a new user.

Although the invention has been described with respect to the above-mentioned embodiments, it should be understood that other embodiments may be substituted without departing from the scope of the present invention. Accordingly, the invention has been described by way of illustration rather than limitation.

What is claimed is:

1. A display device comprising:

at least three plates including a forwardmost plate and a rearmost plate, the plates comprising:

a first plate having a forward surface and a rearward surface;

a second plate disposed rearwardly of and adjacent to the first plate, the second plate having a forward surface and a rearward surface; and a third plate disposed rearwardly of and adjacent to the second plate, the third plate having a forward surface and a rearward surface; and biasing means for permitting relative movement of adjacent plates between a retracted position and an expanded position when the first plate is pulled generally in a forward direction and for biasing the plates toward the retracted position for returning the plates to the retracted position when the first plate is released, the plates in the retracted position being generally in registration with one another such that the rearward surface of the first plate faces the forward surface of the second plate, and the rearward surface of the second plate faces the forward surface of the third plate whereby generally only the forward surface of the first plate is exposed for viewing information to be displayed thereon from a position generally forward of the display device, the plates in the expanded position oriented such that the forward surface of the first plate, the rearward surface of the second plate and the forward surface of the third plate are exposed for viewing information to be displayed thereon from a position generally forward of the display device, and wherein a portion of the forward surface of the rearmost plate extends beyond edges of the other plates for viewing information to be displayed thereon while the plates are in the retracted position.

2. A display device as defined in claim 1, wherein the first second and third plates each have a first edge and a second edge generally at an opposite end relative to the first edge, the first edge of the first plate serving as a handle to pull the plates from the retracted position to the expanded position, the second edges of the first plate and the second plate being hingedly coupled to each other, and the first edges of the second plate and the third plate being hingedly coupled to each other to further facilitate movement of the plates between the retracted position and the expanded position.

3. A display device as defined in claim 1, wherein the biasing means includes at least one elastic member coupled to the plates.

4. A display device as defined in claim 3, wherein the at least one elastic member includes:

a first elastic member coupling the first plate to the second plate; and a second elastic member coupling the second plate to the third plate.

5. A display device as defined in claim 3, wherein the at least one elastic means is a single elastic member coupling the first plate to the second plate, and coupling the second plate to the third plate.

6. A display device as defined in claim 2, wherein the first, second and third plates each have a third edge and a fourth edge generally at an opposite end relative to the third edge, the third and fourth edges generally extending between the first and second edges, and wherein the biasing means includes:

a first elastic member extending between the first plate and the second plate at locations adjacent to the third and fourth edges of the first and second plates; and a second elastic member extending between the second plate and the third plate at locations adjacent to the third and fourth edges of the second and third plates.

7. A display device as defined in claim 2, wherein the first, second and third plates each have a third edge and a fourth edge generally at an opposite end relative to the third edge, the third and fourth edges generally extending between the first and second edges, and wherein the biasing means includes a single elastic member extending between the first plate, the second plate and the third plate at locations adjacent to the third and fourth edges of the first, second and third plates.

8. A display device as defined in claim 1, wherein the third plate is the rearmost plate relative to the first plate, and further including means for attaching the third plate to a support surface.

9. A display device as defined in claim 8, wherein the attaching means includes adhesive disposed on the rearward surface of the third plate.

10. A display device as defined in claim 8, wherein the third plate is the rearmost plate relative to the first plate, and wherein the third plate includes at least one mounting section defining at least one hole for attaching the third plate to a support surface.

11. A display device as defined in claim 1, further comprising:

a fourth plate disposed rearwardly of and adjacent to the third plate, the fourth plate having a forward surface and a rearward surface; and a fifth plate disposed rearwardly of and adjacent to the fourth plate, the fifth plate having a forward surface and a rearward surface, and wherein the plates in the retracted position being generally in registration with one another such that the rearward surface of the third plate faces the forward surface of the fourth plate, and the rearward surface of the fourth plate faces the forward surface of the fifth plate whereby generally only the forward surface of the first plate is exposed for viewing information to be displayed thereon from a position generally forward of the display device, and the plates in the expanded position being biased toward the retracted position and oriented such that the forward surface of the first plate, the rearward surface of the second plate, the forward surface of the third plate, the rearward surface of the fourth plate, and the forward surface of the fifth plate are exposed for viewing information to be displayed thereon from a position generally forward of the display device.

12. A display device as defined in claim 11, wherein the first, second, third, fourth and fifth plates each have a first edge and a second edge generally at an opposite end relative to the first edge, the first edge of the first plate serving as a handle to pull the plates from the retracted position to the expanded position, the second edges of the first plate and the second plate being hingedly coupled to each other, the first edges of the second plate and the third plate being hingedly coupled to each other, the second edges of the third plate and the fourth plate being hingedly coupled to each other, and the first edges of the fourth plate and the fifth plate being hingedly coupled to each other to further facilitate movement of the plates between the retracted position and the expanded position.

13. A display device as defined in claim 12, wherein the first, second, third, fourth and fifth plates each have a third edge and a fourth edge generally at an opposite end relative to the third edge, the third and fourth edges generally extending between the first and second edges, and wherein the biasing means includes:

a first elastic member extending between the first plate and the second plate at locations adjacent to the third and fourth edges of the first and second plates;

a second elastic member extending between the second plate and the third plate at locations adjacent to the third and fourth edges of the second and third plates;

a third elastic member extending between the third plate and the fourth plate at locations adjacent to the third and fourth edges of the third and fourth plates; and a fourth elastic member extending between the fourth plate and the fifth plate at locations adjacent to the third and fourth edges of the fourth and fifth plates.

14. A display device as defined in claim 12, wherein the first, second, third, fourth and fifth plates each have a third edge and a fourth edge generally at an opposite end relative to the third edge, the third and fourth edges generally extending between the first and second edges, and wherein the biasing means includes a single elastic member extending between the first plate, the second plate, the third plate, the fourth plate and the fifth plate at locations adjacent to the third and fourth edges of the first second, third, fourth and fifth plates.

15. A display device as defined in claim 12, wherein the second edge of the fifth plate projects beyond the second edges of the first through fourth plates whereby a portion of the forward surface of the fifth plate projecting beyond said second edges is exposed for viewing information to be displayed thereon while the plates are in the retracted position.

16. A display device as defined in claim 11, wherein the biasing means includes at least one elastic member coupled to the plates.

17. A display device as defined in claim 16, wherein the at least one elastic member includes:

a first elastic member coupling the first plate to the second plate;

a second elastic member coupling the second plate to the third plate;

a third elastic member coupling the third plate to the fourth plate; and a fourth elastic member coupling the fourth plate to the fifth plate.

18. A display device as defined in claim 16, wherein the at least one elastic means is a single elastic member coupling the first plate to the second plate, coupling the second plate to the third plate, coupling the third plate to the fourth plate, and coupling the fourth plate to the fifth plate.

19. A display device as defined in claim 11, wherein the fifth plate is the rearmost plate relative to the first plate, and further including means for attaching the fifth plate to a support surface.

20. A display device as defined in claim 19, wherein the attaching means includes adhesive disposed on the rearward surface of the fifth plate.

21. A display device as defined in claim 19, wherein the fifth plate is the rearmost plate relative to the first plate, and wherein the fifth plate includes at least one mounting section defining at least one hole for attaching the fifth plate to a support surface.

22. A display device as defined in claim 1, wherein the first yplate defines a projection serving as a handle for pulling the plates from the retracted position to the extended position.

23. A display device comprising:

at least three plates including a forwardmost plate and a rearmost plate, the plates comprising:

a first plate having a forward surface and a rearward surface;

a second plate disposed rearwardly of and adjacent to the first plate, the second plate having a forward surface and a rearward surface; and a third plate disposed rearwardly of and adjacent to the second plate, the third plate having a forward surface and a rearward surface;

biasing means for permitting relative movement of adjacent plates between a retracted position and an expanded position when the first plate is pulled generally in a forward direction and for biasing the plates toward the retracted position for returning the plates to the retracted position when the first plate is released, the plates in the retracted position being generally in registration with one another such that the rearward surface of the first plate faces the forward surface of the second plate, and the rearward surface of the second plate faces the forward surface of the third plate whereby generally only the forward surface of the first plate is exposed for viewing information to be displayed thereon from a position generally forward of the display device, and the plates in the expanded position oriented such that the forward surface of the first plate, the rearward surface of the second plate and the forward surface of the third plate are exposed for viewing information to be displayed thereon from a position generally forward of the display device; and means for attaching the rearmost plate to an external support surface, the attaching means including adhesive disposed on the rearward surface of the rearmost plate.

* * * * *

UNITED STATES PATENT AND TRADEMARK OFFICE

CERTIFICATE OF CORRECTION

PATENT NO. : 7,036,256 B2
APPLICATION NO. : 10/606306
DATED : May 2, 2006
INVENTOR(S) : Carlin, et al.

It is certified that error appears in the above-identified patent and that said Letters Patent is hereby corrected as shown below:

Column 8, Claim 14, Line 66, after the word "first" please insert --,--.

Column 9, Claim 22, line 39, please delete the word "yplate" and replace with --plate--.

Signed and Sealed this

First Day of August, 2006

JON W. DUDAS
*Director of the United States Patent and Trademark Office*